United States Patent [19]

Tripp

[11] 4,024,606

[45] May 24, 1977

[54] PAPER HOLDING

[75] Inventor: John F. Tripp, Medfield, Mass.

[73] Assignee: Dennison Manufacturing Company, Framingham, Mass.

[22] Filed: July 9, 1975

[21] Appl. No.: 594,546

[52] U.S. Cl. ..... 24/67.7; 24/253

[51] Int. Cl.[2] ..... B42F 1/00; A44B 21/00

[58] Field of Search ..... 24/67.7, 253, 67.3, 24/252 R, 252 PC; 248/316 E, 316 F

[56] References Cited

UNITED STATES PATENTS

| | | | |
|---|---|---|---|
| 307,142 | 10/1884 | Rex | 24/252 PC |
| 1,509,303 | 9/1924 | Leyare | 24/253 |
| 1,605,581 | 11/1926 | Heath | 24/252 PC |
| 1,671,869 | 5/1928 | Meader | 24/67.7 |
| 2,488,709 | 11/1949 | Colwell | 24/253 |
| 2,590,297 | 3/1952 | Curtis | 24/253 |
| 3,171,178 | 3/1965 | Smith | 24/253 |
| 3,262,579 | 7/1966 | Reich | 211/45 |

FOREIGN PATENTS OR APPLICATIONS

| | | | |
|---|---|---|---|
| 70,579 | 2/1950 | Denmark | 24/67.7 |
| 394,918 | 5/1924 | Germany | 24/67.7 |
| 1,031,626 | 6/1958 | Germany | 24/253 |
| 15,698 | 7/1907 | United Kingdom | 24/67.7 |

*Primary Examiner*—Bernard A. Gelak
*Attorney, Agent, or Firm*—George E. Kersey

[57] ABSTRACT

A clipboard-type paper holder comprises, as its holding subassembly, a pair of spaced eccentric wheels independently pressured, and cooperatively acting to grip paper in cooperation with a clipboard or other backing surface with equalized clamping force at the spaced location, the wheels being contained in a holder body of smooth surfaced low profile.

8 Claims, 5 Drawing Figures

PAPER HOLDING

BACKGROUND OF THE INVENTION

The present invention relates to paper holding in clipboards and like devices and is characterized by affording improved user safety consistent with compactness and low cost of manufacture.

Clipboards and like devices such as paper holding stubs which may be included on a right or left margin of a form book cover generally comprise a spring loaded, jaw clamp type of holding lock which may, in particular instances, have too little jaw pressure for effective paper holding and locking or too much jaw pressure with the result that there is danger to the user's fingers and/or a danger of paper tearing and/or of unbalanced jaw pressure across the clamping surface.

The profiles of such prior art locking subassemblies make the clipboard, or the like, more bulky than is desirable and may preclude fitting the whole clipboard or like assembly to an attache case along with books and/or files.

It is an important object of the present invention to provide an effective paper holding apparatus.

It is a further object of the invention to provide equalized clamping forces at spaced locations for more effective aligned paper holding with light clamping pressure consistent with the preceding object.

It is a further object of the invention to provide improved user safety in connection with such apparatus by elimination of sharp metal edges and extreme jaw clamp pressures consistent with one or both of the preceding objects.

It is a further object of the invention to provide a paper holding subassembly having a smooth surface to avoid catching on other objects consistent with one or more of the preceding objects.

It is a further object of the invention to provide a paper holding subassembly affording a low profile to clipboards or other end assemblies utilizing such a subassembly consistent with one or more of the preceding objects.

It is a further object of the invention to provide economy of materials and manufacturing costs consistent with one or more the preceding objects.

SUMMARY OF THE INVENTION

In accordance with the present invention, a clipboard or the like comprises in its paper holding subassembly one or more spring loaded, eccentric wheels which grip papers or other materials between a point on the wheel circumference and the backing surface. Gripping pressure increases as the pull on the material increases and is released by manual pressure against the spring loading to rotate the eccentric wheel(s) in the reverse direction.

The wheel(s) may be mounted in a holder of plastic which provides partially open journals for one or more wheel shafts. The journals open towards the backing surface and allow some floating of shafts position spacing in relation to the backing surface. Such journals are contained in cantilevered members extending from a base portion of a holding body as smoothly curved extensions thereof, preferably formed integrally therewith.

Coil springs anchored to each holding body surround the shaft(s) and are hidden by the wheel(s) to avoid snagging, but arranged cooperatively with each wheel to provide clamping pressure. Such pressure may be relieved for paper insertion and removal by pressing on the wheel directly or via a lever.

These and other objects, features and advantages of the invention will be apparent from the following detailed description of preferred embodiments taken in connection with the accompanying drawings in which:

DETAILED DESCRIPTION OF PREFERRED EMBODIMENTS

Figure 1:
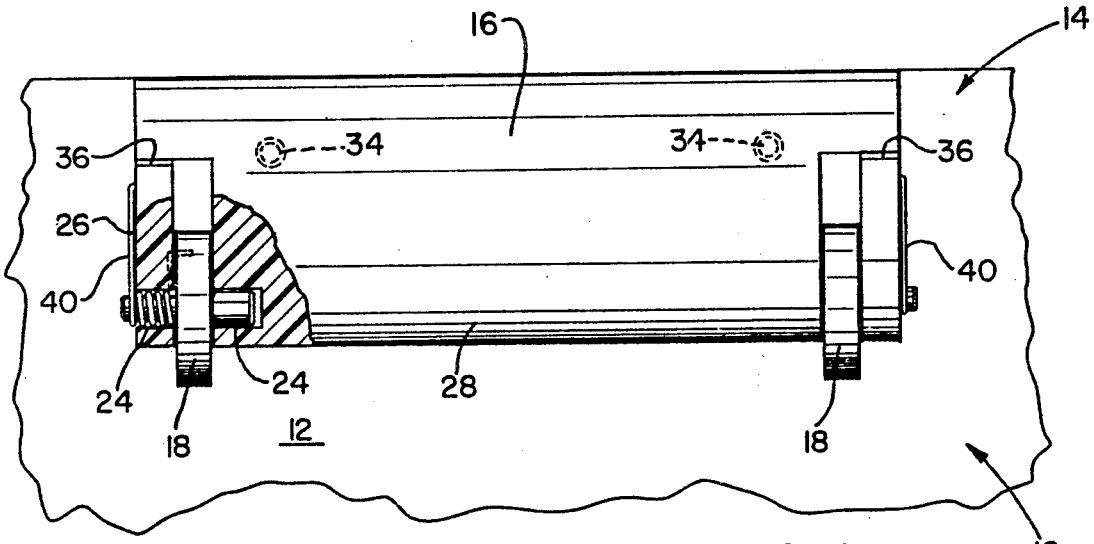
FIG. 1 is a top view of a clipboard in accordance with a first preferred embodiment of the present invention.
Figure 2:
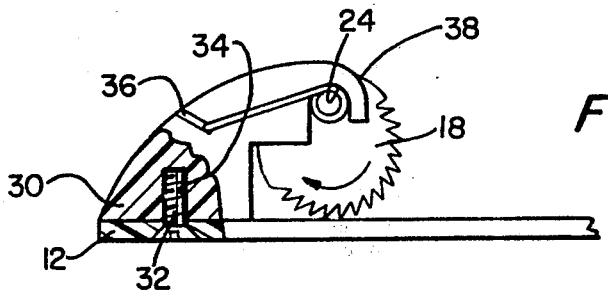
FIG. 2 is a sideview of the FIG. 1 clipboard.
Figure 3:
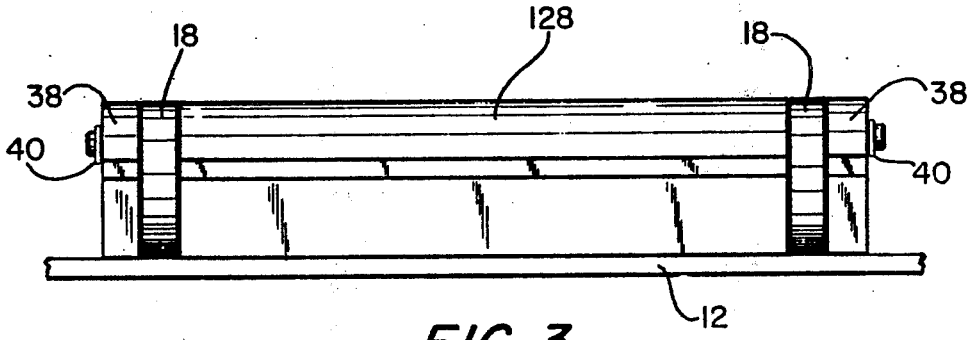
FIG. 3 is a face view of a portion of the clipboard.

Referring now to FIGS. 1–3 there is shown a clipboard 10 comprising a backing plate 12 and a locking subassembly 14, which comprises a holder member 16 and a pair of spaced wheels 18 each of which is mounted on a shaft 22 extending out of both ends thereof mounted in journals 24 contained in end extensions 26 of the holder body 16 and also in a main central extension of the holder body 16. The shafts 22 are located eccentrically in wheels 18 to define cams. Springs 40 are secured to and end extensions 26, coil around each shaft 22 where it passes through the journals 24 and end in a tie to wheels 18. Finger pressure on the wheels lifts them against compressive spring pressure. The clamping force is inherently distributed equally between the wheels.

The materials of construction are typically thermoplastic for the wheels, holding body and extension, and steel for the shaft and springs. It will be appreciated however that various other materials including natural and synthetic plastics, rubber, wood and metal may be applied. The holding body 16 comprises base portion 30 secured to the clipboard backing portion 12 by screws 32 engaged in holes 34 in the base portion. The end extensions 26 begin at necked in portions defined by angled slots 36 cut into the holding body to anchor the spring ends to the cantilevered end portions. The outer surface of the holding body is preferably defined as a large radius cylinder portion, typically 1½ inch radius ending in extensions 26/28 in a tight radius portion, indicated at 38 in FIG. 2, typically ¼ inch.

Figures 4A, 4B:
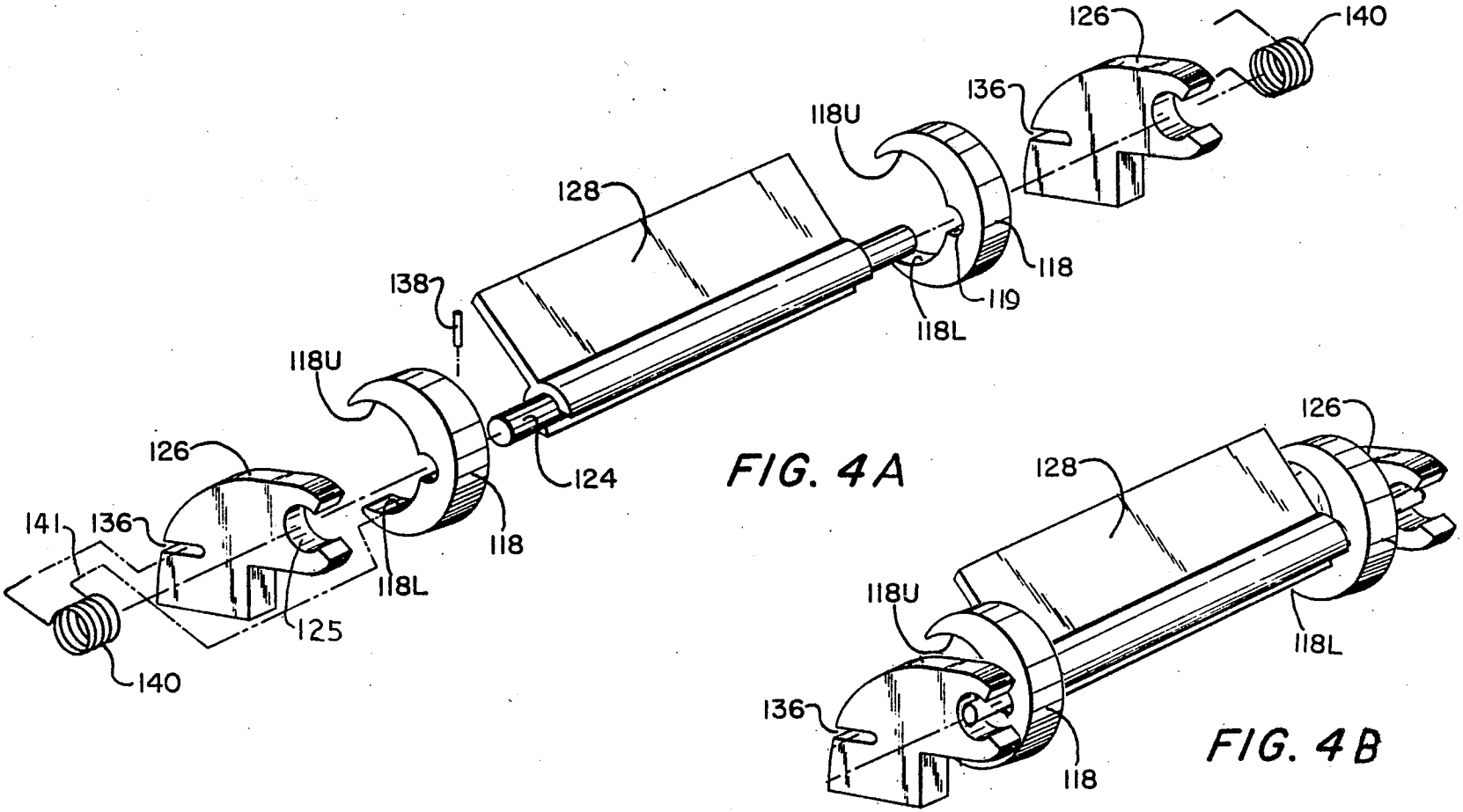
FIG. 4A is an exploded view and FIG. 4B is an assembled view of parts of a holding subassembly of a clipboard in accordance with a second preferred embodiment of the invention, all or substantial portions of the backing surface of a clipboard being cut away in all of FIGS. 1–4 as unnecessary in connection with illustrating the present invention.

FIG. 4A shows, in isometric form, exploded parts of a second embodiment comprising holding bodies 126, a common shaft 124 mounting two partial wheel cresents 118 (each of which has an upper portion 118U and a lower portion 118L) via cutouts 119 therein. Springs 140, secured in a slot 136 of each holding body 126 coil around a shaft 124 while passing through journal cutouts 125 and end with spring ends 141 bearing on portions 118L to provide clamping pressure. Such clamping pressure is relieved at all wheels 118 by lifting a lever tab 128 to bear against portions 118U for loading or unloading paper. A stop 138 on the clipboard backing (or a curvature of 128, if desired) limits movement of 128 to define a rest position of low profile avoiding inadvertant clamping pressure release.

FIG. 4B is an assembled view of the second embodiment.

It is evident that those skilled in the art, once given the benefit of the foregoing disclosure, may now make numerous other uses and modifications of, and departures from the specific embodiments described herein without departing from the inventive concepts. Consequently, the invention is to be construed as embracing each and every novel feature and novel combination of features present in, or possessed by, the apparatus and techniques herein disclosed and limited solely by the scope and spirit of the appended claims.

What is claimed is:

1. A clipboard comprising a backing member, a handle fixedly secured to a shaft with extending pivot ends, two cresent shaped cams each having a slot on an inner surface to receive a pivot end of said shaft, two supports having recesses for receiving the shaft ends, a spring coiled about each pivot end of said shaft and having one end secured to one of said supports and another end engaging an inner surface of each cam, said spring securing the shaft ends in the recesses of said supports and biasing the cams and the handle toward said backing member.

2. A clipboard in accordance with claim 1 wherein each of said cams has a toothed outer surface to increase gripping of sheets applied to said base member.

3. A clipboard in accordance with claim 1 wherein each of said cams has a smooth outer surface for gripping sheets with respect to said base member without indentation.

4. A clipboard in accordance with claim 1 wherein each of said cams has its springs proportioned for equal distribution of clamping force with respect to said base member.

5. A clipboard in accordance with claim 1 wherein said handle is an elongated cantelever and said supports are end holder cantelevers.

6. A clipboard in accordance with claim 1 wherein each cam is operable by direct finger pressure applied thereto.

7. A clipboard in accordance with claim 1 further including a stud secured to said base member for limiting the downward movement of said handle.

8. A clipboard in accordance with claim 1 wherein said supports have a curved continuous profile free of corners and snagging projections.

* * * * *